US006666283B2

(12) United States Patent
Frauhammer et al.

(10) Patent No.: US 6,666,283 B2
(45) Date of Patent: Dec. 23, 2003

(54) HAND HELD POWER TOOL

(75) Inventors: Karl Frauhammer, Leinfelden-Echterdingen (DE); Frank Mueller, Deckenpfronn (DE); Karl Treyz, Leonberg (DE); Heinz Schnerring, Dettenhausen (DE); Joerg Friedrich, Leinfelden-Echterdingen (DE); Andreas Strasser, Rudersberg (DE); Hubert Steinke, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 93 days.

(21) Appl. No.: 09/764,022

(22) Filed: Jan. 16, 2001

(65) Prior Publication Data

US 2001/0009190 A1 Jul. 26, 2001

(30) Foreign Application Priority Data

Jan. 22, 2000 (DE) ..... 100 02 748

(51) Int. Cl.[7] ..... B25D 15/00

(52) U.S. Cl. ..... 173/93.5; 173/93; 173/93.6; 464/37; 192/56.1

(58) Field of Search ..... 173/93.5, 93, 93.6; 464/35, 37, 38

(56) References Cited

U.S. PATENT DOCUMENTS

| | | | | | |
|---|---|---|---|---|---|
| 924,749 | A | * | 6/1909 | Drapeir | 464/37 |
| 2,909,047 | A | * | 10/1959 | Muller et al. | 464/36 |
| 3,203,523 | A | * | 8/1965 | Gilder et al. | 192/56.57 |
| 3,593,542 | A | * | 7/1971 | Urayama | 464/37 |
| 3,688,522 | A | | 9/1972 | Schmuck | |
| 3,770,086 | A | * | 11/1973 | Jackson et al. | 192/16 |
| 3,991,590 | A | * | 11/1976 | Brems et al. | 192/56.1 |
| 4,263,789 | A | * | 4/1981 | Koepke et al. | 192/56.62 |
| 4,275,500 | A | * | 6/1981 | Speer et al. | 30/240 |
| 4,365,962 | A | * | 12/1982 | Regelsberger | 173/104 |
| 4,417,650 | A | * | 11/1983 | Geisthoff | 192/56.1 |
| 4,566,570 | A | * | 1/1986 | Geisthoff | 464/37 |
| 4,651,847 | A | * | 3/1987 | Hermanns | 180/245 |
| 4,792,321 | A | * | 12/1988 | Lundquist | 192/56.1 |
| 4,836,296 | A | * | 6/1989 | Biek | 173/93.5 |
| 5,090,532 | A | * | 2/1992 | Bich | 464/37 |
| 5,092,410 | A | * | 3/1992 | Wallace et al. | 173/93.5 |
| 5,924,536 | A | * | 7/1999 | Frenken | 192/56.1 |
| 6,012,985 | A | * | 1/2000 | Sukup | 464/37 |
| 6,082,513 | A | * | 7/2000 | Li | 192/56.1 |
| 6,241,613 | B1 | * | 6/2001 | Lewis et al. | 464/37 |

FOREIGN PATENT DOCUMENTS

| | | | | |
|---|---|---|---|---|
| DE | 1 965 275 | | 7/1971 | |
| DE | 29 36 755 A1 | | 3/1981 | |
| DE | 2936755 A1 | * | 3/1981 | F16D/7/04 |
| DE | 38 32 202 C1 | | 3/1990 | |
| EP | 0 040 261 A1 | | 11/1981 | |
| JP | 9-141572 | | 3/1997 | |
| JP | 9-141572 A | * | 6/1997 | B25D/16/00 |

* cited by examiner

*Primary Examiner*—Rinaldi I. Rada
*Assistant Examiner*—Louis Tran
(74) *Attorney, Agent, or Firm*—Michael J. Striker

(57) ABSTRACT

A hand power tool has at least one safety coupling arranged in a drive train, the safety coupling having at least two coupling elements for transmitting a torque around a rotary axis, at least one arresting element which is spring loaded and held in a guiding passage for connecting the coupling elements with one another, a guiding element, a spring providing spring-loading of the arresting element and supported in direction of the arresting element by the guiding element, the guiding element being non rotatably guided relative to an axis extending parallel to the rotary axis by guiding surfaces in the guiding passage, and the arresting element unlatching and keeping in contact with a surface toward which the arresting element is urged by the spring in response to exceeding of predetermined torque.

17 Claims, 5 Drawing Sheets

HAND HELD POWER TOOL

BACKGROUND OF THE INVENTION

The present invention relates generally to hand held power tools.

Hand power tools are known and widely utilized. In order to avoid uncontrollable rotation of a hammer drill which is held by a user during blocking a drill or a drill crown in a masonry, it is known to connect the drill or the drilling crown with a drive of the hammer drill through a safety coupling. The safety coupling opens when the drill is blocked.

German patent document DE 38 32 202 C1 discloses a hand power tool with such a safety coupling. The safety coupling for transmission of torque has a first radially inner coupling part and a second coupling part which surrounds the first coupling part. The coupling parts are connected with one another through arresting elements which are formed as rollers. The rollers are guided in a first coupling part in guiding passages. Springs are arranged in the guiding passages and are supported at their first ends against a passage bottom. With their second ends, they act radially outwardly on the rollers in direction to the second coupling part and press the rollers into the recesses of the second coupling part. When a predetermined torque is exceeded, the rollers are pressed radially inwardly from the recesses against the springs and open the safety coupling. The rollers slide subsequently over the recesses.

SUMMARY OF THE INVENTION

Accordingly, it is an object of present invention to provide a hand power tool which is a further improvement of the existing hand power tools.

More particularly, it is an object of the present invention to provide a hand power tool with at least one safety coupling in a drive train which for transmission a torque around a rotary axis has at least two coupling elements connected with one another through an arresting element loaded by a spring and held in a guiding passage, which interrupts arresting in response to exceeding of a predetermined torque.

In keeping with these objects and with others which will become apparent hereinafter, one feature of present invention resides, briefly stated, in a hand power tool of the above mentioned type, in which the spring is supported in direction of the arresting element through a guiding element, which is non rotatably guided through guiding surfaces in the guiding passage at least around an axis extending parallel to the rotary axis.

A bending moment transmitted from the arresting element to the spring, a buckling of the spring, a contact of the spring with a passage wall and thereby loading and a spring breakage can be avoided, and a long service life can be obtained, in particular for fast rotating hand power tools.

The guiding passages can be produced by various methods and can have various cross-sections, for example round, ellipsoidal or conical cross-sections. The guiding passages can be for example drilled or sintered, and the guiding passages which are sintered can be formed for example with corners.

The spring can be supported in direction of the arresting element through various supporting surfaces which are shaped in a known manner, for example through a curved, concave and/or convex supporting surfaces. A tilting moment caused by the supporting surface can be avoided in a structurally simple and cost favorable manner by a flat supporting surface, whose normal line extends parallel to an actuating direction of the guiding element in the guiding passage.

In accordance with a further embodiment of the present invention, the spring at its end which faces the guiding element and/or at its end which faces away from the guiding element, is guided through a short recess and/or a short projection. The spring can be exactly positioned during mounting, and then during operation held in its position. The spring over its whole length can operate free without guidance. The guiding passage can be formed with a sufficient distance from the spring with its side walls, in the case of open safety coupling, or in other words with compressed spring. A contact between the side walls of the guiding passage and the spring, as well as friction and wear can be avoided, and a long service life can be provided.

In accordance with a further embodiment of the present invention, it is further proposed that the spring is oriented parallel to the side walls of the guiding passage. An equal distance between the spring and the side walls can be provided over the length of the spring, and in space economical manner, a contact between the spring and the side walls can be avoided.

When the elastic element is formed as a component which is rotatable around an axis extending parallel to the rotary axis, the friction and wear between the arresting element and the corresponding coupling element is reduced by a rolling movement. For saving additional components, mounting expenses and costs, the arresting element or the guiding element can be formed of one piece with one another. Furthermore, when the guiding element and the arresting element are formed of one piece, a gap-free connection between the arresting element and the guiding element can be provided.

The spring can act on the guiding element through one or several components or preferably directly. Additional components, structural space and costs can be therefore saved.

In accordance with another embodiment of the present invention, the arresting element can be pressed by the spring against an operational curve, on which the arresting element is always guided with a simple linear contact, and preferably through a linear contact which extends perpendicular to a movement direction of the arresting element.

The arresting element, in the case of the open safety coupling, can be guided along the operational curve in a strike-free manner. Sudden movements of the arresting element, the guiding element and the spring and thereby resulting spring breakage can be avoided, and in particular the settling phenomena of the spring can be reduced.

A hydrodynamic sliding film of lubricant can be provided between the arresting element and the operational curve. For this purpose the arresting element is supported on the operational curve, so that between the curve and the arresting element a diverging gap is formed in a movement direction of the arresting element.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
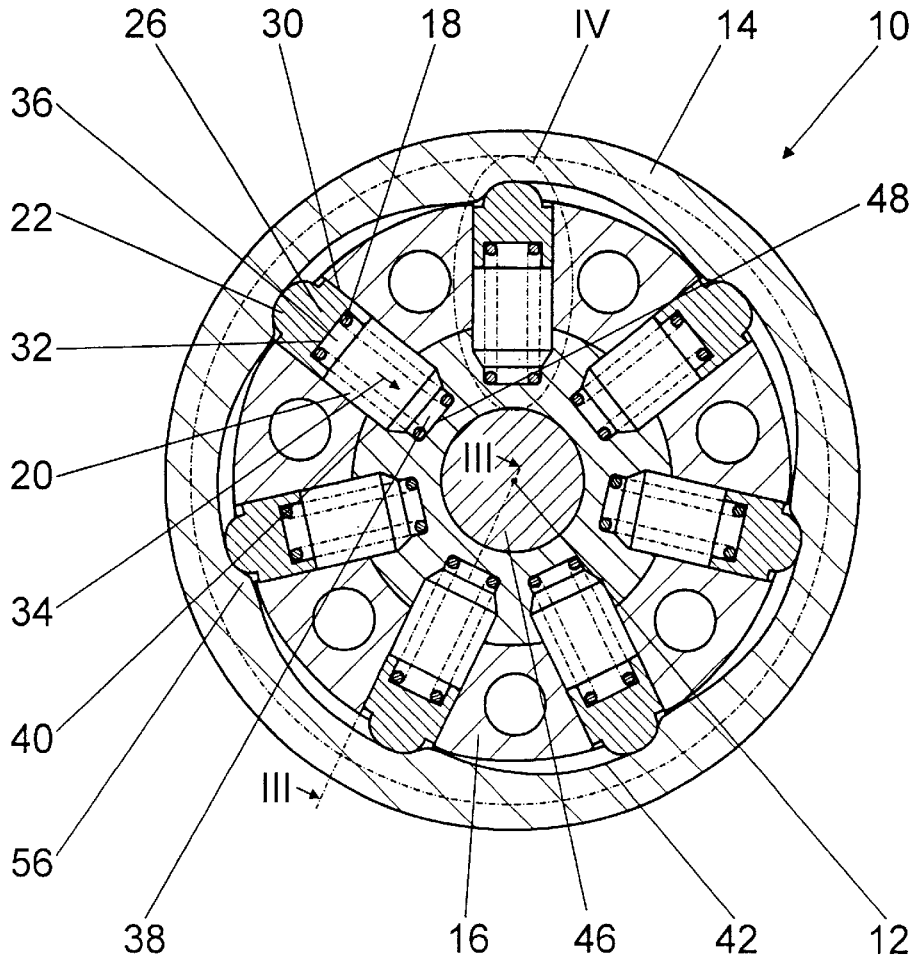
FIG. 1 is a view showing a section of a safety coupling of an inventive hand power tool, in a closed condition.

FIG. 1 is a view showing a safety coupling 10 of a hammer drill, which has two coupling elements 14, 16 for transmission of a torque around a rotary axis 12. The coupling elements include a coupling disk 16 which is connected to the shaft 46 through a press fit, and a spur tooth gear 14 which surrounds the coupling disk and is rotatably supported on the shaft 46. The coupling disk 16 and the spur tooth gear 14 are connected with one another through seven arresting elements 22. The arresting elements 22 are symmetrically distributed from the periphery. They are loaded with a spring 18 and held each in a guiding passage 20. The guiding passages 20 are formed in the coupling disk 16 during sintering and have a rectangular cross-sectional surface.

In accordance with the present invention, the spring 18 are each supported in direction of the arresting element 22 on guiding pistons 26 which are formed of one piece with the arresting element 22. The guiding pistons 26 are non rotatably guided via guiding surfaces 30 in the guiding passage, in particular around an axis extending parallel to the rotary axis 12. The guiding pistons 26 have a rectangular cross-sectional surfaces which corresponds to that of the guiding passages 20.

Figure 3:
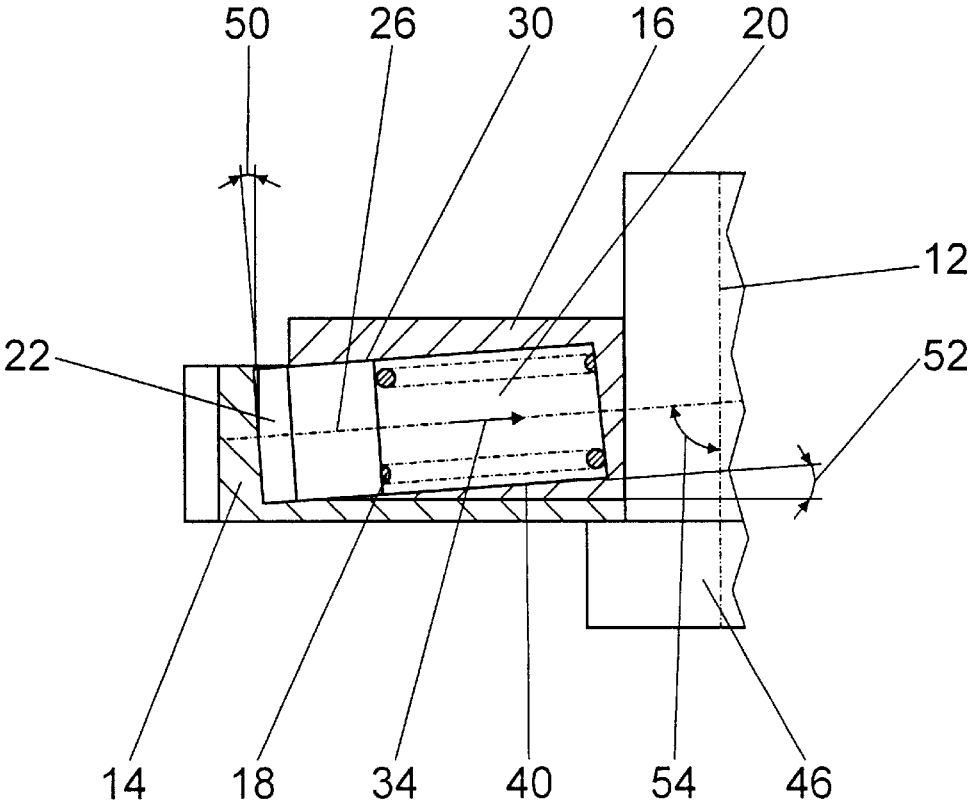
FIG. 3 is a view showing a section taken along the line III—III in FIG. 1.
Figure 4:
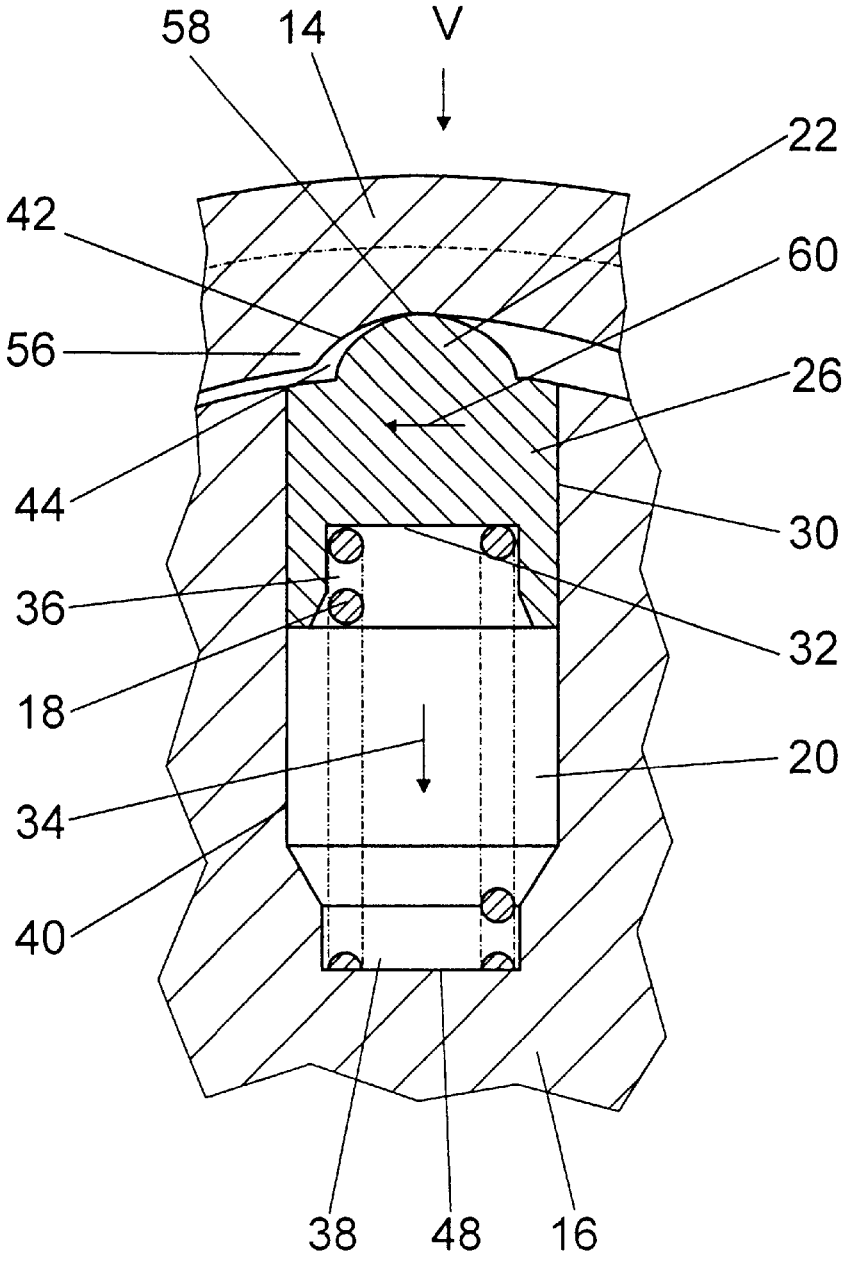
FIG. 4 is a view showing a portion identified with reference IV in FIG. 1 on an enlarged scale.

The spring 18 is supported in direction of the arresting element 22 on a flat supporting surface 32, and is supported in direction facing away from the arresting element 22 on a flat supporting surface 48, whose normals extend parallel to a movement direction 34 of the guiding piston 26 in the guiding passage 20, as shown in FIGS. 1, 3, 4. Furthermore, the spring 18 is oriented parallel to the side walls 40 of the guiding passages 20. Inclines 50, 52, for removing of the extruding coupling disk 16 and the spur tooth gear 14 from the mold, are shown in FIG. 3. With the orientation of the supporting surfaces 32, 48 and the side walls 40 over the spring 18 taken into consideration, they are formed so that the movement direction 34 of the guiding piston 26 in the guided passage 20 encloses an angle 54 less than 90° to the rotary axis 12.

The spring 18 is guided with a first end in a short, cylindrical recess 36 in the guiding piston 26, and with a second, opposite end is guided in a short, cylindrical recess 38. A guiding passage 20 extends conically toward the recess 38, which is produced by drilling.

Figure 2:
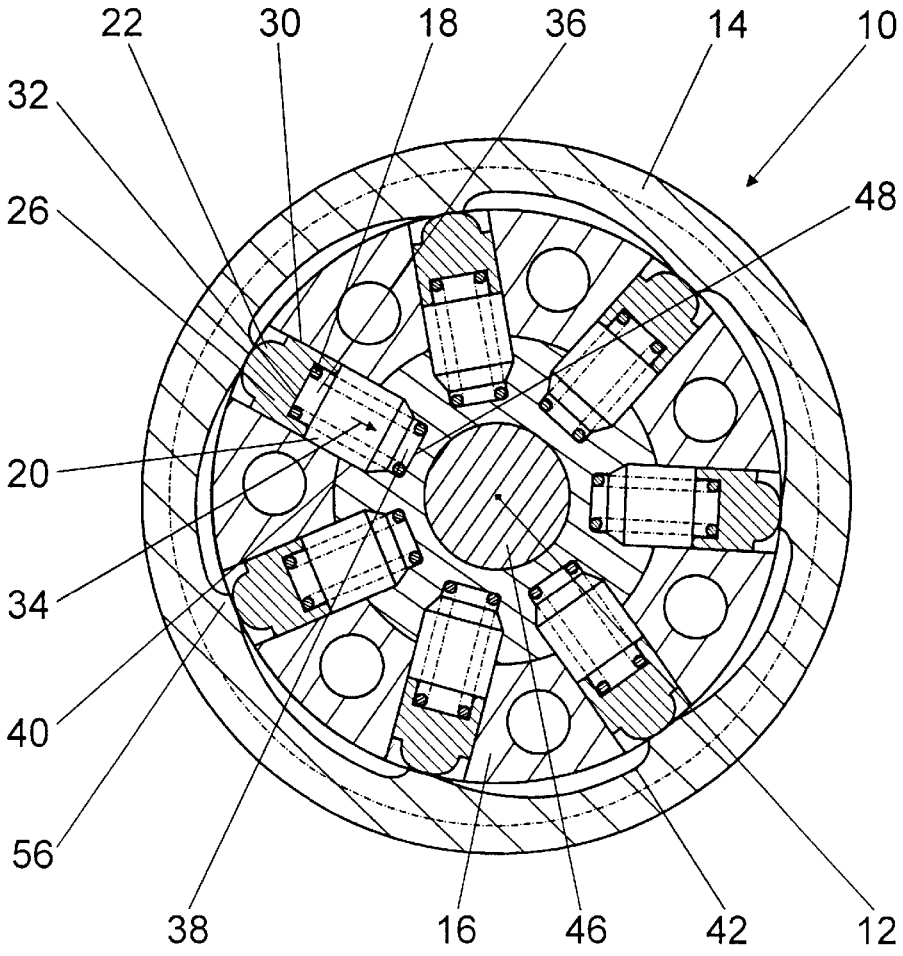
FIG. 2 is a view showing the safety coupling of FIG. 1, in an open condition.

The arresting elements 22 can be pressed by the springs 18 radially outwardly against an operational curve 42 which is formed at the radially inwardly facing side of the spur tooth gear 14. During a conventional operation, the arresting elements 22 are held on cams 56 of the operational curve 42. When a predetermined torque is exceeded, for example when a drill of the hammer drill is blocked in a masonry, the arresting elements 22 are displaced with the guiding piston 26 in the guiding passages 22 against the springs 18 radially inwardly in the movement direction 34 as shown in FIG. 2. The guiding passages 20 with their side walls have a sufficient distance from the springs 18 in the case of open safety coupling 10, or in other words with the springs 18 are compressed. This reliably prevents contact of the springs 18 with the side walls 40 of the guiding passages 20.

Figure 5:
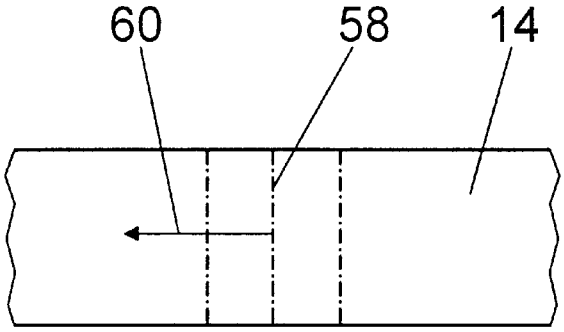
FIG. 5 is a view showing a portion of a view as seen in direction 5 in FIG. 4.

The arresting elements 22 are supported on the operational curve 42 always through a simple linear contact which extends perpendicular to a movement direction 60 of the arresting elements 22. Thereby a jumpy movement of the arresting elements 20, the guiding pistons 26 and the springs 18 during running over the cams 56 is avoided, as can be seen from FIG. 5. Between the arresting element 22 and the operational curve 42 a gap 44 which diverges in the movement direction 60 of the arresting element 22 is provided. Therefore, a hydrodynamic sliding film can be formed between the arresting elements 32 and the operational curve 42 by a lubricant in the open condition of the safety coupling, as can be seen from FIG. 4.

Figure 6:
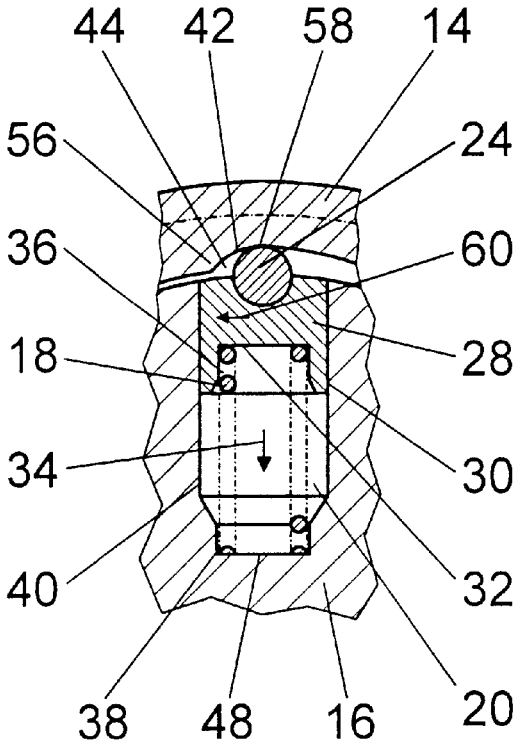
FIG. 6 is a view showing another variant of the embodiment of FIG. 4 for the inventive hand power tool.

FIG. 6 shows an arresting element 24 which is formed as a roller. It is supported in a calotte of a guiding piston 28. Substantially similar components are identified basically with the same reference numerals. Furthermore, similar features and operations corresponding to the embodiment of FIGS. 1–5 are not repeated.

In this embodiment the arresting element 24 which is formed as a roller can rotate around an axis extending parallel to the rotary axis 12. Thereby the friction between the operational curve 42 and the arresting element 24 can be reduced. The guiding piston 28 is provided up to the arresting element 24, in correspondence with the guiding piston 26. It is non rotatably guided through the guiding surface 30 in the guiding passage 20, in particular around the axis extending parallel to the rotary axis 12.

It will be understood that each of the elements described above, or two or more together, may also find a useful application in other types of constructions differing from the types described above.

While the invention has been illustrated and described as embodied in hand held power tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A hand power tool, comprising at least one safety coupling arranged in a drive train, said safety coupling having at least two coupling elements for transmitting a torque around a rotary axis; at least one arresting element which is spring loaded and held in a guiding passage for connecting said coupling elements with one another; a guiding element; a spring providing spring-loading of said arresting element and supported in direction of said arresting element by said guiding element, said guiding element being non rotatably guided relative to an axis extending parallel to said rotary axis by guiding surfaces in said guiding passage, and said arresting element unlatching and keeping in contact with a surface toward which said arresting element is urged, during latching, by said spring in response to exceeding of predetermined torque; and means for guiding said spring at an end facing away from said guiding element and including a short recess, said recess having a smaller diameter than said guiding passage and also having guiding surfaces extending parallel to a moving direction of said guiding element, said recess being formed so that it supports said spring to keep a distance to side walls of said guiding passage for reducing friction and wear of said spring.

2. A hand power tool as defined in claim 1, wherein said spring is supported in direction of said arresting element on a flat supporting surface whose normal extends parallel to a movement direction of said guiding element in said guiding passage.

3. A hand power tool as defined in claim 1; and further comprising means for guiding said spring at an end which faces said guiding element, said guiding means including a short recess.

4. A hand power tool as defined in claim 1; and further comprising means for guiding said spring at an end which faces said guiding element, said guiding means including a short projection.

5. A hand power tool as defined in claim 1; and further comprising means for guiding said spring at an end facing away from said guiding element, said guiding means including a short projection.

6. A hand power tool as defined in claim 1, wherein said guiding passage has side walls which are spaced from said spring when said safety coupling is open.

7. A hand power tool as defined in claim 1, wherein said guiding passage has side walls, said spring extending parallel to said side walls of said guiding passage.

8. A hand power tool as defined in claim 1, wherein said arresting element is formed by a component which is rotatable at least around an axis extending parallel to said rotary axis.

9. A hand power tool as defined in claim 1, wherein said arresting element and said guiding element are formed of one piece with one another as an integral component.

10. A hand power tool as defined in claim 1, wherein said spring is supported in said guiding element.

11. A hand power tool as defined in claim 1; and further comprising means forming an operational curve, said arresting element being pressed by said spring against said operational curve so that said arresting element is guided with a linear contact.

12. A hand power tool as defined in claim 1; and further comprising means forming an operational curve, said arresting element being supported in said operational curve, so that between said operational curve and said arresting element a gap which diverges in a movement direction of said arresting element is provided.

13. A hand power tool as defined in claim 11, wherein said arresting element is supported on said operational curve always through a simple linear contact.

14. A hand power tool as defined in claim 11, wherein said operational curve includes a cam and has a curvature with a wider radius at a side of said cam in displacement direction of said arresting element than at a side of said cam against the displacement direction.

15. A hand power tool as defined in claim 1, wherein said spring is unguided over a major part of a length of said spring.

16. A hand power tool as defined in claim 1, wherein said at least two coupling elements transmit a torque around said rotary axis which encloses an angle less than 90° with a movement direction of said guiding element in said guiding passage.

17. A hand power tool, comprising at least one safety coupling arranged in a drive train, said safety coupling having at least two coupling elements for transmitting a torque around a rotary axis; at least one arresting element which is spring loaded and held in a guiding passage for connecting said coupling elements with one another; a guiding element; a spring providing spring-loading of said arresting element and supported in direction of said arresting element by said guiding element, said guiding element being non rotatably guided relative to an axis extending parallel to said rotary axis by guiding surfaces in said guiding passage, and said arresting element unlatching and keeping in contact with a surface toward which said arresting element is urged, during latching, by said spring in response to exceeding of predetermined torque; and means for guiding said spring at an end which faces said guiding element and including a short recess, said recess having a smaller diameter than said guiding passage and also having guiding surfaces extending parallel to a moving direction of said guiding element, said guiding surfaces being formed so that they support said spring to keep a distance to side walls of said guiding passage for reducing friction and wear of said spring, wherein said spring is unguided and outside of said guiding means over a major part of a length of said spring.

* * * * *